United States Patent [19]

Miller

[11] 4,260,47

[45] Apr. 7, 198

[54] PROCESS FOR DESULFURIZING COAL AND PRODUCING SYNTHETIC FUELS

[75] Inventor: J. Wayne Miller, Yorba Linda, Calif.

[73] Assignee: Union Oil Company of California, Brea, Calif.

[21] Appl. No.: 55,063

[22] Filed: Jul. 5, 1979

[51] Int. Cl.[3] ..... C10G 1/00

[52] U.S. Cl. ..... 208/8 LE; 208/8 R; 208/10; 44/1 R

[58] Field of Search ..... 208/8 R, 8 LE, 10; 44/1 R

[56] References Cited

U.S. PATENT DOCUMENTS

| | | | |
|---|---|---|---|
| 3,926,575 | 12/1975 | Meyers | 44/1 R |
| 4,047,898 | 9/1977 | Cole et al. | 44/1 R |
| 4,054,421 | 10/1977 | Robinson et al. | 44/1 |
| 4,071,328 | 1/1978 | Sinke | 44/1 |
| 4,094,820 | 6/1978 | Mickelson | 252/4( |
| 4,113,605 | 9/1978 | Mickelson | 208/21 |

*Primary Examiner*—Veronica O'Keefe

*Attorney, Agent, or Firm*—Cleveland R. Williams; Dea Sandford

[57] ABSTRACT

A process for sequentially reducing the amount of py ritic, organic and sulfate sulfur in coal and other carbc naceous materials and for producing synthetic fuels b contacting coal or a carbonaceous material with wate an acid and hydrogen at increased temperature an pressure. Coal or carbonaceous material-volatile prod ucts are collected and upgraded to produce syntheti fuels.

19 Claims, 1 Drawing Figure

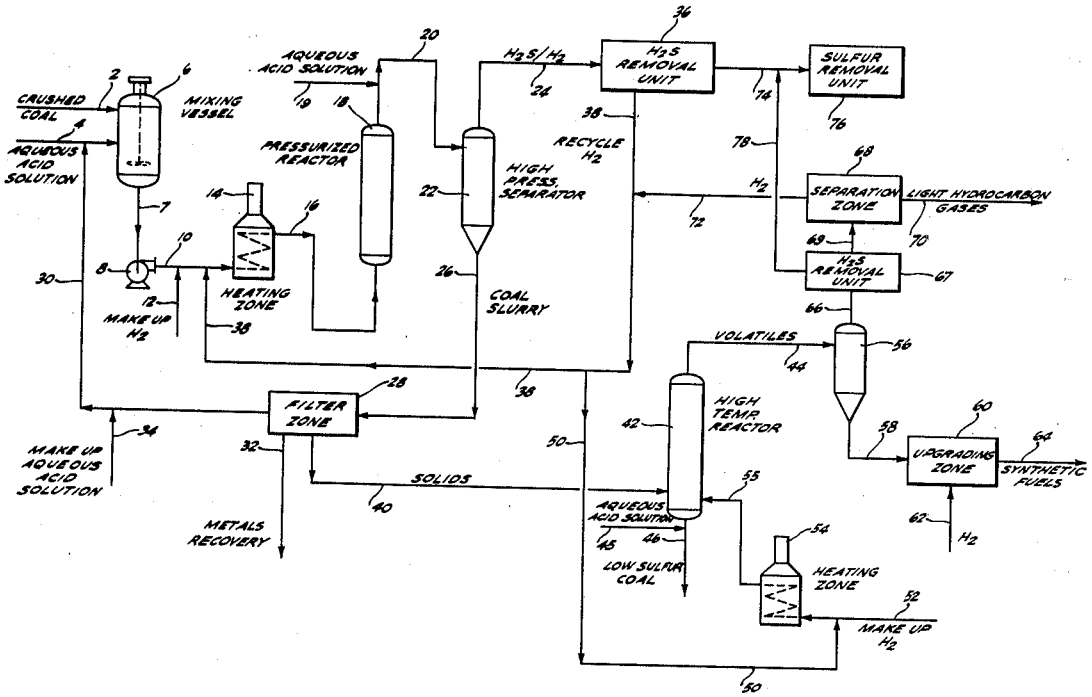

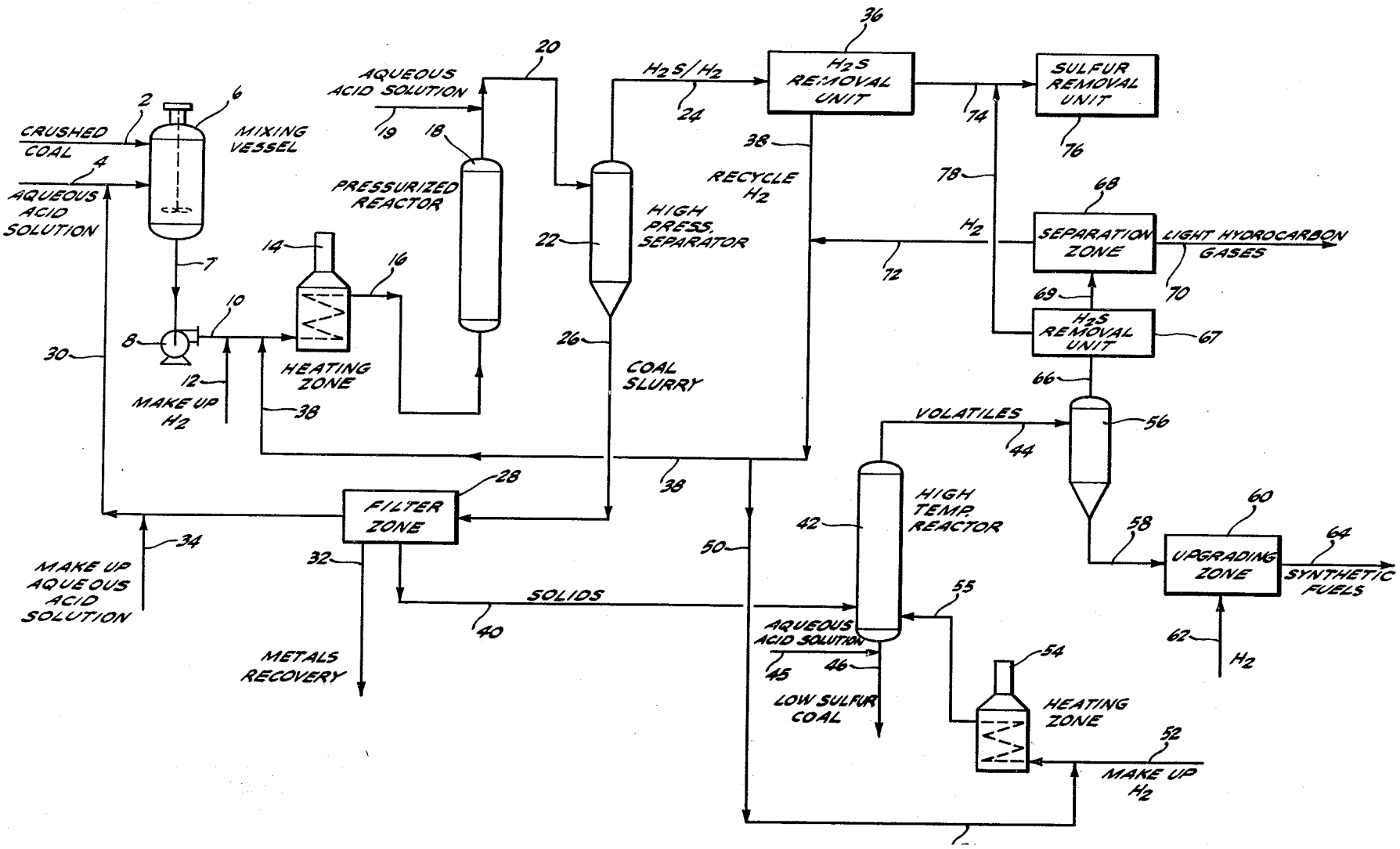
CRUSHED COAL
AQUEOUS ACID SOLUTION
MIXING VESSEL
MAKE UP H2
HEATING ZONE
PRESSURIZED REACTOR
AQUEOUS ACID SOLUTION
H2S/H2
H2S REMOVAL UNIT
RECYCLE H2
HIGH PRESS SEPARATOR
COAL SLURRY
SULFUR REMOVAL UNIT
SEPARATION ZONE
LIGHT HYDROCARBON GASES
H2S REMOVAL UNIT
VOLATILES
UPGRADING ZONE
SYNTHETIC FUELS
HIGH TEMP. REACTOR
HEATING ZONE
MAKE UP H2
AQUEOUS ACID SOLUTION
LOW SULFUR COAL
SOLIDS
FILTER ZONE
METALS RECOVERY
MAKE UP AQUEOUS ACID SOLUTION

PROCESS FOR DESULFURIZING COAL AND PRODUCING SYNTHETIC FUELS

BACKGROUND OF THE INVENTION

1. Field of the Invention

Coal represents approximately 84 percent of the known recoverable fossil fuel resources in the United States, while petroleum and natural gas account for about 10 percent and shale oil for the remaining 6 percent.

The shrinking petroleum and natural gas reserves around the world, and recently enacted governmental sulfur oxides emission standards in the United States, have highlighted the need to focus attention on coal desulfurization and conversion technology and the production of synthetic fuels therefrom to meet the growing demand for energy in the United States and around the world.

The sulfur content of coals ranges from approximately 0.2 percent to as much as 7 percent as mined. Sulfur does not occur as an element in coal, but three sulfur forms in chemical combination are recognized. Most of the sulfur, approximately 40 to 80 percent, occurs as a constituent of pyrite or marcasite. These polysulfides are deposited as famboids in peat and are formed by the reaction between ferrous ions and hydrogen sulfide which is derived from the action of anerobic bacteria on sulfates. The remainder of the sulfur occurs as hydrous ferrous sulfate ($FeSO_4.7H_2O$) derived by weathering of pyrites, as gypsum ($CaSO_4.2H_2O$), and as organic sulfur in combination with coal-formed vegetal material (macerals). The amount of sulfate sulfur is very small, generally less than about 0.1 percent. Organic sulfur is presumed to exist as sulfides, disulfides, mercaptans, and heterocyclic rings, for example thiophene.

Sulfur has always been an objectionable constituent of coal and other carbonaceous materials normally used to generate power and energy. Combustion of coal or other carbonaceous materials is by far the largest single source of atmospheric sulfur dioxide pollution in the United States, accounting for approximately two-thirds of the total sulfur oxide emissions.

With the rapidly diminishing oil supply and the present world-wide emphasis on the energy crisis, increased attention by both government and private organizations is being given to coal and synthetic fuels produced therefrom as an alternate energy source. However, depending upon their origin, coals contain varying amounts of sulfur in the form of pyrite, organic sulfur and sulfate sulfur from which sulfur dioxide is formed when coal, and synthetic fuels produced from coal are burned. Hence, there is an ongoing search to convert high sulfur content coal into a usable fuel which would meet current air quality standards and, additionally, help to aleviate the current shortage of crude oil. The best processes which are known to the art, generally do not combine a process for desulfurizing coal or carbonaceous materials and producing a synthetic fuel.

2. Brief Description of the Prior Art

The problem of separating sulfur and other impurities and producing synthetic fuels from coal and carbonaceous materials is known and several processes have been extensively tested over the years. One such process is set forth in U.S. Pat. No. 3,926,575 which discloses a process for reducing the pyritic content of coal, which comprises reacting finely divided coal with sulfuric or hydrochloric acid. An alternate method is disclosed for removing sulfur from coal which involve: addition to an acid leach, a final extraction step inv ing use of a solvent, for example, benzene, etc.

Another process is disclosed in U.S. Pat. 4,071,328 which relates to a method of removing su from coal which consists of hydrogenating the coa remove a portion of sulfur therefrom. Next, the hyc genated coal is contacted with an aqueous inorg acid solution to remove some of the sulfur initially c bined as pyritic sulfur.

U.S. Pat. No. 4,054,421 relates to a process for red ing the sulfur content of chars made from coal, by w ing the char with an acid followed by treatment w hydrogen gas. Particularly, coal is converted to c and thereafter introduced into an acid bath, compris an aqueous solution of a mineral acid, for example drochloric acid.

A process for upgrading solid fuels is disclosed U.S. Pat. No. 4,047,898 which teaches treatment of l rank fuels, for example, subbituminous coals with w under increased temperature and pressure in the p ence of hydrogen. Particularly, the patent disclose method for the benefication of low rank solid f which consists of mixing a low rank fuel with wa heating the mixture to a temperature above 300° F. at a pressure sufficient to maintain water in the liq phase under reaction conditions, for a time period su cient to reduce the sulfur and ash content and incre the fuel BTU value. As can readily be determined fr the above, there is an ongoing search for new and m efficient processes for desulfurizing coal and carbo ceous materials and for producing useful synthetic f therefrom.

SUMMARY OF THE INVENTION

The present invention resides in a process for de furizing coal or other carbonaceous materials and p ducing synthetic fuels which comprises contacting c or a carbonaceous material with hydrogen, water a /or an aqueous media in an amount sufficient to m tain the pH from about 1.0 to about 6.0, at a temperat of from about 350° F. to about 650° F., a pressure fr about 100 p.s.i.g. to about 4,000 p.s.i.g. for about hour to about 30 hours; contacting the coal or carbo ceous material with hydrogen at a temperature of fr about 800° F. to about 1,700° F., a pressure of fr atmospheric pressure to about 500 p.s.i.g., at a hydro flow rate of from about 100 to about 5,000 volume hydrogen per volume of coal or carbonaceous mate per hour, for about 0.1 hour to about 50 hours. T volatile products produced in the process are collec and upgraded to produce synthetic fuels.

BRIEF DESCRIPTION OF THE DRAWING

The drawing is a simplified flow diagram schem cally illustrating the process disclosed herein.

DESCRIPTION OF THE PROCESS

The present invention resides in a process for de furizing coal and other carbonaceous materials, additionally for producing synthetic fuels therefr using hydrogen, water and an acid in combination w a second hydrogenation step at increased temperatu Sulfur, bonded in pyritic and organic compounds converted into a sulfide compound which may be tracted or leached from the coal or carbonaceous m rial with an acid. Extraction of the sulfides with dic compound results in dissolution of the sulfide mpounds and the release of sulfur as hydrogen sul-e. The hydrogen sulfide is, then, sent to a hydrogen fide absorbing solution, for example an amine solu-n, where hydrogen sulfide is recovered.

Organic sulfur is removed from the coal or carbona-ous material by contacting extracted coal or carbona-ous material with hydrogen at high temperatures. At se temperatures, hydrogen reacts with organic sulfur mpounds to form hydrogen sulfide which is readily covered as sulfur.

Anthracitic materials, bituminous and subbituminous al, lignitic materials, peat, coke and other types of al products referred to in ASTM Designation: D-388-(reapproved 72) are examplary of the solid carbona-ous materials which may be treated in accordance th the process of the present invention to produce v sulfur coal and synthetic fuels therefrom. The coal, or to use in the process of the invention, is preferably lverized using a suitable apparatus, for example, a nmermill, etc., to a size such that at least 90 percent the coal will pass through a 200 mesh (U.S. Series) ve. The ground coal is then slurried in a suitable vent, for example, water or a water-acid mixture, ore introduction into a pressurized reaction vessel to contacted with other components to promote sulfur noval thereform.

Coals and other solid carbonaceous materials that y be used herein, include any high sulfur coal or bonaceous material, preferably of the following nposition on a moisture free basis.

TABLE I

| | Weight Percent | |
|---|---|---|
| | Broad Range | Typical Range |
| Carbon | 45–95 | 60–92 |
| Hydrogen | 2.5–7.0 | 4.0–6.0 |
| Oxygen | 2.0–45 | 3.0–25 |
| Nitrogen | 0.75–2.5 | 0.75–2.5 |
| Sulfur | 0.3–10 | 0.5–6.0 |

llustrative examples of suitable coals or carbona-ous materials include anthracite, lignite, peat, coke, tsburgh seam coal, Kentucky coal, Indiana #3 coal, oming coal and the like. It should be noted that the fur content of the above-described coals or carbona-ous materials may vary greatly even in one particular l field and the above coals and carbonaceous materi-are illustrative of coals and carbonaceous materials t may be treated in accordance with the process ein.

A coal, selected from the group consisting of anthra-, bituminous, subbituminous, lignite, etc., or other bonaceous material described in ASTM Designa-: D-388-66 (reapproved 72), is crushed to a suitable ticle size using conventional apparatus. A desirable ticle size range is from about 60 to about 400 stan-d mesh, preferably from about 100 to about 300 ndard mesh, especially where 90 percent passes ough a 200 standard mesh sieve.

n a preferred mode, crushed coal, water and acid are oduced through lines 2 and 4 into mixing vessel 6 to pare a slurry. A wide variety of acids may be used in process herein; suitable acids include hydrochloric d, nitric acid, phosphoric acid, sulfuric acid or acetic d and mixtures thereof. It should be noted that the d is introduced into the process as an aqueous media ich comprises a mixture of acid and water, normally volume ratio of from about 1:20 to about 20:1. The aqueous media, preferably, maintains the coal slurry pH level at less than 6.0, especially from about 1.0 to about 6.0. Normally, the coal and aqueous media are combined in a weight ratio of from about 1:20 to about 20:1.

The coal slurry, including water and aqueous media, is transferred through lines 7 and 10, using pump 8 or similar device, with hydrogen from line 12, to heating zone 14 where the temperature is increased to 650° F., especially from about 350° F. to about 650° F. Pump 8 is representative of devises normally used to transport the coal slurry through the system herein; it should be noted that pumps, such as pump 8, compressors or blowers, may be strategically placed throughout the system to ensure a smooth flow of components through said system.

Next, the coal slurry, including water, acid and hydrogen, is transported through line 16 to pressurized reaction zone 18, where the pressure is increased up to 4,000 p.s.i.g., preferably from about 100 p.s.i.g. to about 4,000 p.s.i.g., especially from about 500 p.s.i.g. to about 1,500 p.s.i.g., for about 0.5 hour to about 30 hours. Essentially all of the pyritic sulfur is removed from the coal during this stage of the process, however, most of the organic sulfur remains. Additionally, metals such as iron sulfide are reduced by the action of hydrogen and the acid, to hydrogen sulfide, soluble ferrous ions, and possibly elemental iron.

It should be noted that heating zone 14 and pressurized reactor 18 may be either separate units as depicted in the drawing or may be combined as one unit without detrimental effect to the process. In a second mode, water may be introduced into mixing vessel 6 with coal and transported through line 7, pump 8 and line 10, with hydrogen from line 12, to heating zone 14, line 16 and pressurized reactor 18. The coal is, next, washed with an aqueous media, introduced through line 19, which maintains the pH level of this step of the process below 4.0, especially from about 1.0 to about 4.0.

The reactants are transferred through line 20 to high pressure separator 22 where a reactant gas phase, comprising hydrogen and hydrogen sulfide, is separated from the reactant solid and/or liquid phase comprising coal, an aqueous media comprising water and an acid, and metals produced in the reduction of pyritic sulfur. Hydrogen and hydrogen sulfide are transported through line 24 to hydrogen sulfide removal unit 36 where hydrogen sulfide is separated from hydrogen using, for example, a hydrogen sulfide adsorbent such as mono or diethanol amine. Hydrogen sulfide is transported through line 74 to sulfur removal unit 76 where sulfur is recovered, for example, by using the Claus process or some similar procedure. Hydrogen is recirculated through line 38 into line 10 and heating zone 14 and through lines 50 and 52 into heating zone 54.

The coal slurry, including solids and liquids, is transferred from high pressure separator 22 through line 26 to filter zone 28, where coal is separated from metals and aqueous media comprising water and acid. The aqueous media is recirulated through lines 30 and 4 into mixing vessel 6. Make-up aqueous solution is introduced through lines 34, 30 and 4 into vessel 6. Alternatively, the aqueous media may be recirculated to contact the coal after treatment in the pressurized reactor.

Metals are transported through line 32 to metals recovery facilities. Coal is transferred through line 40 into high temperature reactor 42, where hydrogen is introduced through lines 50 and 52 into heating zone 54 where the hydrogen is heated to a temperature above about 800° F. and introduced through line 55 into high temperature reactor 42 where organic sulfur is removed from the coal. It should be noted that heating zone 54 may be either a separate unit as depicted in the drawing or it may be combined as a single unit with high temperature reactor 42.

The reaction temperature is maintained using any suitable heating apparatus, for example, a furnace, electrical heater or the like. The temperature at which the reaction is carried out, normally, is within the range of from about 800° F. to about 1,700° F., especially from about 1,200° F. to about 1,500° F., a pressure of from atmospheric pressure to about 500 p.s.i.g., preferably from atmospheric pressure to about 100 p.s.i.g., for about 0.1 hour to about 50 hours, preferably from about 0.1 hour to about 10 hours. Hydrogen is introduced into the reaction vessel at a minimum rate of 100 volumes of hydrogen per volume of coal per hour, preferably from about 100 to about 5,000 volumes of hydrogen per volume of coal per hour. A substantial amount of the organic sulfur is removed from the coal at this stage of the process. Organic sulfur is converted to hydrogen sulfide which is separated from the coal and transported to sulfur removal apparatus. Low sulfur coal is transported through line 45 to storage facilities.

When water is introduced into the system in the absence of an acid, the water and coal are combined in an amount sufficient to form a coal slurry. Normally, the coal and water are combined in a weight ratio of from about 1:20 to about 20:1.

Alternatively, water may be introduced into mixing vessel 6 with coal and transported through line 7, pump 8 and line 10, with hydrogen from line 12, to heating zone 14, line 16 and pressurized reactor 18. The coal slurry, including solids and water, is transferred from high pressure separator 22 through line 26 to filter zone 28, where coal is separated from metals and water. Coal is transferred through line 40 into high temperature reactor 42, where hydrogen is introduced through lines 50 and 52 into heating zone 54 where the hydrogen is heated to a temperature above about 800° F. and introduced through line 55 into high temperature reactor 42 where organic sulfur is removed from the coal. Next, the coal is washed with an aqueous media, introduced through line 45, which maintains the pH level at this step of the process below 4.0, especially from about 1.0 to about 4.0. Low sulfur coal is transported through line 45 to storage facilities.

Approximately 20 percent to about 45 percent by weight of the coal is converted to volatiles which are readily recoverable as synthetic fuels, including gas and liquid products. Synthetic liquid fuels produced from the coal are primarily aromatic and generally have a boiling range of from about 300° F. to about 1,400° F., a density of about 0.1 to about 1.1 and a carbon to hydrogen molecular ratio in the range of from about 1.3:1 to about 0.66:1. A typical example is a solvent oil obtained from a subbituminous coal such as Wyoming-Montana coal, comprising a middle oil having a boiling range of from about 375° F. to about 675° F. Other products derived from the coal or carbonaceous material include unsaturated hydrocarbons such as the $C_2$+ mono olefins, for example, ethylene, propylene, isopropylene, etc., and other light hydrocarbon gases, such as, methane, ethane, propane, etc. The synthetic fuels herein may conveniently be upgraded to suitable fuels using conventional apparatus and techniques in the art.

Volatiles produced in high temperature reactor 42 ar transferred through line 44 to separation zone 56 wher liquid condensates are separated from gases produced i the process. The liquid condensates are transferre through line 58 to upgrading zone 60, including hydro gen introduced via line 62, where the liquid condensat is upgraded to liquid synthetic fuels. Gas volatiles ar transported through line 66 to hydrogen sulfide re moval unit 67 where trace amounts of hydrogen sulfid are removed using an adsorbent solution such as a amine compound and transported through lines 78 an 74 to sulfur removal unit 76 where sulfur is recovered Hydrogen and light hydrocarbon gases are transporte through line 69 to gas separation zone 68 where ligh hydrocarbon gases are separated from hydrogen. Ligh hydrocarbon gases, for example, methane, ethane, pro pane, etc. are transported through line 70 to storag facilities. Hydrogen is recirculated into the proces through lines 72 and 38 into line 10 and heating zone 1 and through line 38 into lines 50, 52 and heating zone 54

Volatiles produced in the process may be upgrade into useful synthetic fuels using apparatus and tech niques known in the art. For example, volatiles may b transported to a separator unit where light hydrocarbo gases and condensible oils are conveniently recovere using condensation techniques and apparatus com monly used in the industry. Oil produced in the proces is transported to an atmospheric distillation towe where low boiling oils are separated from high boilin oils using a standard distillation tower. Light synthetic oils, boiling in the range of 200° F. to 700° F., are trans ported to a reaction unit where the synthetic oils ar contacted with hydrogen and a hydrogenation catalys at a temperature between about 550° F. and 750° F., a a pressure between about 500 p.s.i.g. and 1,500 p.s.i.g. utilizing a weight hourly space velocity (WHSV) be tween about 0.25 and about 50 kilograms of synthetic oi per kilogram of catalyst per hour, and added hydroge in amounts between about 5 and about 1000 cubic me ters per barrel of synthetic oil. The exact condition selected will depend, for example, upon the catalys used, the particular charge stock to be treated, and th degree of conversion desired. It should be noted, that a low a temperature as possible should be used to limit th number of undesirable side reactions, such as coke for mation, which are promoted by high temperatures. Th low boiling synthetic oils are primarily converted int gasoline, diesel fuel, turbine fuel, naphtha and light fue oil.

Any hydrogenation catalyst well known to those having ordinary skill in the art may be employed herein but preferably, the catalyst comprises at least one hy drogenating component selected from the group con sisting of metals, metal sulfides and/or metal oxides o Groups VI and VIII of the Periodic Table. Particularly preferred among the hydrogenating metals are nickel cobalt, molybdenum and tungsten. The hydrogenating metals are preferably composited with a porous sup port, for example, alumina or silica-alumina. Addition ally, these Group VI and Group VIII catalysts ma employ promoters selected from the elements o Groups II and IV of the Periodic Table. The most pre ferred promoters are Ti, Zr, Sr, Mg, Zn, and Sn. Th promoters are employed at levels not in excess of abou eight percent by weight of the catalyst used.

Particularly desirable catalysts, suitable for us herein, are set forth in U.S. Pat. Nos. 4,113,605 an 4,094,820, which are directed to carbonates and/o hydroxides of one or more of the Group VIII metals, crystalline cobalt and/or nickel molybdate interreacted with gelatinous boehmite alumina. The resulting catalysts are then extruded, dried, calcined and are found to be very active for desulfurization, denitrogenation and other hydrogenation reactions, for example, upgrading synthetic fuels.

The disclosures of the above-described patents are incorporated herein by reference. The catalysts are used in an amount sufficient to upgrade synthetic oil to useful fuel products.

The higher boiling synthetic oils are distilled under vacuum and the overhead is treated in accordance with the procedure and catalysts described above for the low boiling synthetic oils at a temperature of from about 500° F. to about 800° F. and from about 500 p.s.i.g. to about 3,000 p.s.i.g. The products upgraded at this stage of the process include turbine fuel and feedstock for a hydrocracker, fluid catalytic cracker or coker.

The residual from the vacuum distillation is subjected to a hydrocracking reaction using standard equipment and techniques to produce low sulfur synthetic fuels. Any type reaction vessel may be used in this invention which is normally used in the art.

The invention is further described by the following examples which are illustrative of specific modes of practicing the invention as defined by the appended claims.

EXAMPLE I

Indiana #3 coal is desulfurized and synthetic fuels are produced therefrom according to the procedure described below. The coal is analyzed according to the procedure set forth in ASTM Designations: D-1372-73, D-3176-74 and D-2492-77, the results are disclosed in Table II below:

TABLE II

| INDIANA #3 COAL | |
|---|---|
| Proximate Analysis | Moisture-Free Basis % by Weight |
| Ash | 17.6 |
| Volatile Carbon | 40.8 |
| Fixed Carbon | 41.6 |
| Ultimate Analysis | Moisture-Free Analysis % by Weight |
| Carbon | 65.20 |
| Hydrogen | 4.90 |
| Nitrogen | 1.28 |
| Sulfur | 4.32 |
| Ash | 17.58 |
| Oxygen | 6.72 |
| Form of Sulfur | Moisture-Free Basis % By Weight |
| Pyritic | 1.88 |
| Organic | 2.25 |
| Sulfate | 0.20 |

A one-liter autoclave is loaded with 400 cc of water, 10 cc of 85 percent phosphoric acid, and 23.18 grams of Indiana #3 coal, which has been pulverized to 60/100 standard mesh. The autoclave is pressurized with hydrogen to 500 p.s.i.g. and heated to a temperature of 750° F. for twelve hours with constant agitation. The maximum pressure reached during this stage of the process is 1,400 p.s.i.g.

Upon opening the autoclave, it is noted that the coal has retained its solid form and is easily separated from the aqueous phase. The coal is analyzed for sulfur content and found to contain 2.09 percent by weight sulfur.

To a quartz tube is loaded 5.64 grams of the pretreated coal. Hydrogen is introduced into the quartz tube at a flow rate of 1,500 volumes of hydrogen per volume of coal per hour for two hours at 1,400° F. and atmospheric pressure. The recovered solid (3.43 grams) is free flowing, has a sulfur content of 0.08 percent by weight and a BTU value of 12,800.

Volatile hydrocarbons released during the high temperature reaction of the process amounted to 39.18 percent by weight of the coal or carbonaceous material introduced into the high temperature reactor. The volatile hydrocarbons produced in the quartz tube are first separated into light hydrocarbon gases and liquid synthetic oils using standard condensation apparatus. The hydrocarbon gases contain methane, ethane, propane, etc. The synthetic oils are introduced into a standard atmospheric distillation column where low boiling oils are separated from high boiling oils.

The low boiling oils are introduced into a pressurized reactor and contacted at 650° F. and 500 p.s.i.g. with hydrogen and a hydrogenation catalyst as described above at a weight hourly space velocity of 1.0 kilogram of low boiling synthetic oil per kilogram of catalyst per hour and added hydrogen in an amount of 1,000 cubic meters per cubic meter of oil. Fuels produced from the low boiling oils include gasoline, turbine fuel, diesel fuel and light fuel oil.

High boiling synthetic oils are vacuum distilled in a vacuum distillation tower and the overhead is hydrotreated according to the procedure disclosed for the low boiling synthetic oils to produce heavy fuel oils and feedstock for hydrocrackers, fluid catalytic crackers or cokers. Vacuum distillation residuals are blended to produce low sulfur fuel oil or sent to a coker.

EXAMPLE II

Indiana #3 coal, as described in Example I, is desulfurized and synthetic fuels are produced therefrom by loading a one-liter autoclave with 250 cc of water and 18.56 grams of said coal, which has been pulverized to 60/100 standard mesh. The autoclave is pressurized to 500 p.s.i.g. with hydrogen and heated to 550° F. for six hours with agitation. A maximum pressure of 1,100 p.s.i.g. is recorded during the run and the final pressure is 495 p.s.i.g. Upon opening the autoclave, it is noted that the coal is free flowing and is easily separated from the solution. The coal is washed with 200 cc of 20 percent hydrochloric acid and analyzed for sulfur content. The analysis indicates that the coal contains 2.1 percent by weight of sulfur.

A quartz tube is loaded with 6.40 grams of the recovered coal and heated for two hours in contact with hydrogen at a temperature of 1,400° F. and a hydrogen flow rate of 1,500 volumes of hydrogen per volume of coal per hour at atmospheric pressure. The recovered coal is analyzed for sulfur content and is found to contain 0.5 percent by weight of sulfur and, additionally, has a BTU value of 12,800.

The procedure of Example I is followed to prepare useful low-sulfur fuels from the volatiles (23.43 percent by weight of the original coal).

EXAMPLE III

Indiana #3 coal substantially as described in Example I is desulfurized and synthetic fuels are prepared therefrom according to the below-described procedure.

Into a one-liter autoclave is loaded 400 cc of water and 23.18 grams of coal, which has been pulverized to 60/100 standard mesh. The autoclave is pressurized with hydrogen to 500 p.s.i.g. and heated to 550° F. for twelve hours with constant agitation. It is noted, upon opening the autoclave, that the coal is easily separated from the solution by filtration. Analysis of the coal indicates that it contains 2.62 percent by weight of sulfur.

A quartz tube is loaded with 9.22 grams of the pretreated coal and heated to 1400° F. for two hours in contact with hydrogen at a hydrogen flow rate of 1,500 volumes of hydrogen per volume of coal per hour under atmospheric pressure conditions. The recovered solid (5.61 grams) is free flowing, has a sulfur content of 0.95 percent by weight and a BTU value of 12,800. The recovered coal is washed with 200 cc of 20 percent hydrochloric acid and reanalyzed for sulfur content. The analysis indicates that the coal contains 0.41 percent by weight of sulfur.

The volatiles (39.15 percent by weight) produced in the process are treated in accordance with the procedure of Example I to prepare usable low sulfur synthetic fuels.

Obviously, many modifications and variations of the invention, as hereinabove set forth, can be made without departing from the spirit and scope thereof, and therefore only such limitations should be imposed as are indicated in the appended claims.

I claim:

1. A process for sequentially reducing the amount of pyritic, organic and sulfate sulfur in coal and other carbonaceous materials and producing synthetic fuels which comprises (a) forming a slurry by contacting said coal or carbonaceous material with hydrogen and an acidic-aqueous media in an amount sufficient to maintain the pH level below 6.0, at a temperature from about 300° F. to about 650° F. and a pressure from about 100 p.s.i.g., to about 4,000 p.s.i.g., and (b) contacting the coal or carbonaceous material with hydrogen at a temperature from about 800° F. to about 1,700° F., at a minimum hydrogen flow rate of from about 100 to about 5,000 volumes of hydrogen per volume of coal or carbonaceous material per hour.

2. The process according to claim 1 wherein the coal or carbonaceous material in step (a) is first contacted with hydrogen and water; and wherein said coal or carbonaceous material is thereafter contacted with said acidic-aqueous media in an amount sufficient to maintain the pH level below about 4.0.

3. The process according to claims 1 or 2 wherein the acidic aqueous media comprises water and an acid selected from the group consisting essentially of hydrochloric acid, nitric acid, phosphoric acid, sulfuric acid or acetic acid and mixtures thereof.

4. The process of claim 1 wherein the coal or carbonaceous material is contacted with the acidic aqueous media in a weight ratio of from about 1:20 to about 20:1 in step (a).

5. The process according to claim 1 having a pH level of from about 1.0 to about 6.0 in step (a).

6. The process according to claim 1 wherein the coal or carbonaceous material in step (a) is contacted with hydrogen and the acidic aqueous media at a temperature of from about 350° F. to about 650° F. and a pressure of from about 200 p.s.i.g. to about 4,000 p.s.i.g., for about 0.5 hour to about 30 hours.

7. The process according to claim 2 wherein the ( or carbonaceous material in step (a) is first contac with said hydrogen and said water at a temperatur from about 350° F. to about 650° F. and a pressur from about 100 p.s.i.g. to about 4,000 p.s.i.g. for ab 0.5 hour to about 30 hours.

8. The process according to claim 2 wherein the ( or carbonaceous material is contacted with the aci aqueous media in a weight ratio of from about 1:2( about 20:1.

9. The process according to claim 2 wherein a level of from about 1.0 to about 4.0 is maintained.

10. The process according to claim 1 wherein the ( or carbonaceous material in step (b) is contacted v hydrogen at a temperature of from about 800° F about 1,700° F., a pressure of from atmospheric press to about 500 p.s.i.g., at a hydrogen flow rate of fr about 100 to about 5,000 volumes of hydrogen per ume of coal or carbonaceous material per hour, about 0.1 hour to about 50 hours.

11. The process according to claim 1 including ( lecting and upgrading the coal or carbonaceous m rial volatile products to produce synthetic fuels.

12. A process for reducing the amount of pyri organic and sulfate sulfur in coal and other carbc ceous materials and producing synthetic fuels wh comprises (a) forming a slurry by contacting coal ( carbonaceous material with hydrogen and water a temperature from about 300° F. to 650° F. and a p sure from about 100 p.s.i.g. to about 4,000 p.s.i.g.; next, contacting the coal or carbonaceous material v hydrogen from about 800° F. to about 1,700° F., a minimum hydrogen flow rate from about 100 to ab 5,000 volumes of hydrogen per volume of coal or car naceous material per hour; and (c) thereafter, cont ing the coal or carbonaceous material with an aci aqueous media in an amount sufficient to maintain ph level of said slurry below about 4.0.

13. The process of claim 12 wherein the coal or ( bonaceous material in step (a) is contacted with hyd gen and water at a temperature of from about 350° F about 650° F. and a pressure of from about 200 p.s.i.g about 4,000 p.s.i.g. for about 0.5 hour to about 30 hoı

14. The process of claim 12 wherein the coal or ( bonaceous material is contacted with water in a wei ratio of from about 1:20 to about 20:1 in step (a).

15. The process of claim 12 wherein the coal or ( bonaceous material in step (b) is contacted with hyd gen at a temperature of from about 800° F. to ab 1,700° F., a pressure of from atmospheric pressure about 500 p.s.i.g., at a hydrogen flow rate of from ab 100 to about 5,000 volumes of hydrogen per volume coal or carbonaceous material per hour, for about hour to about 50 hours.

16. The process of claim 12 wherein the acidic aq ous media in step (c) comprises water and an acid lected from the group consisting essentially of hyd chloric acid, nitric acid, phosphoric acid, sulfuric a or acetic acid and mixtures thereof.

17. The process of claim 16 wherein the coal or c bonaceous material is contacted with the aqueous me in a weight ratio of from about 1:20 to about 20:1 in s (c).

18. The process of claim 17 having a pH level of fr about 1.0 to about 4.0 in step (c).

19. The process of claim 17 including collecting a upgrading the coal or carbonaceous material vola products to produce synthetic fuels.

* * * * *